United States Patent [19]

Fireman et al.

[11] Patent Number: 4,829,611

[45] Date of Patent: May 16, 1989

[54] SOFA BED RECLINER

[76] Inventors: Robert Fireman, 785 West End Ave., New York, N.Y. 10025; Gary Shaffield, 220 Gillen Dr., Sparta, Tenn. 38583

[21] Appl. No.: 180,398

[22] Filed: Apr. 12, 1988

[51] Int. Cl.[4] ..... A47C 17/04

[52] U.S. Cl. ..... 5/47; 5/37 R; 5/41

[58] Field of Search ..... 5/37, 47, 147, 41; 297/354

[56] References Cited

U.S. PATENT DOCUMENTS

| | | | |
|---|---|---|---|
| 702,959 | 6/1902 | Jones | 5/47 |
| 820,826 | 5/1906 | Sèng | 5/47 |
| 828,124 | 8/1906 | Kelly | 5/47 |
| 839,118 | 12/1906 | Crouch | 5/47 |
| 871,022 | 11/1907 | Anthony | 5/47 |
| 2,294,475 | 9/1942 | McAllister | 5/47 |

FOREIGN PATENT DOCUMENTS

| | | | |
|---|---|---|---|
| 79499 | 7/1955 | Denmark | 5/41 |

*Primary Examiner*—Alexander Grosz
*Assistant Examiner*—Michael J. Milano
*Attorney, Agent, or Firm*—Auslander & Thomas

[57] ABSTRACT

A sofa bed recliner which provides a sturdy, simpler inexpensive structure for reverting a seat frame and back frame from a horizontal position to a reclining position by the engagement of a freely pivotable detent, which interlocks the frames, allowing the frames to be simultaneously moved from a horizontal to a reclining position. The detent is automatically released as the back frame resumes reclining position.

13 Claims, 5 Drawing Sheets

SOFA BED RECLINER

BACKGROUND OF THE INVENTION

The present invention is a sofa bed recliner, an improvement of U.S. Pat. No. 4,642,823, with a simple lock, inexpensive mechanism enabling the seat frame and back frame to lockably engage to be easily reset as a unit from the horizontal bed position to a recliner position. The lifting of the seat frame interlocks the seat frame and back frame. Then, an easy downward movement of the seat frame returns the interlocked frame of the sofa bed recliner from its horizontal position to its reclining position. In moving the interlocked seat frame and back frame to resume the reclining position, the interlock also is released once the sofa bed recliner is in recliner position. The seat frame may then again be moved forward to again assume the horizontal bed position. The present invention is adapted to be used with a futon.

DESCRIPTION OF THE PRIOR ART

U.S. Pat. No. 4,642,823 discloses a sofa bed recliner where the seat frame and back frame have a complex tether spring and detent mechanism, which effectuates a seat frame and back frame interlock similar to that of the present invention. The present invention enables the same interlocking relationship and a locking release in a sturdy construction, with a minimum of parts, a simpler operation and a simpler sofa bed recliner structure.

The prior art is replete with complex structures for sofa beds where the seat and back rest may be laid flat for use as a bed. Exemplary of such structures are U.S. Pat. No. 2,796,987 and U.S. Pat. No. 1,982,930, where complex structures convert the back rest of the seat of a sofa bed from the seat or recliner to a usable bed.

A relatively simple structure, as disclosed in U.S. Pat. No. 715,114 still requires an awkward pushing to have the seat frame and back resume their prior position.

BRIEF SUMMARY OF THE INVENTION

According to the present invention, only the seat frame need be lifted and then moved down while the interlocked seat frame and back frame are guided to recliner position.

The sofa bed recliner comprises a seat portion and a back portion. The back portion includes an extension portion. The seat portion and back portion are movably engaged on a base. There are guide means adapted to guide the back portion to move substantially forward and back and substantially up and down on said base. The joined back portion and seat portion are adapted to move forward to a horizontal position and back to a reclining position on the base. There is a detent on the seat portion including a pivot. The detent is preferably freely movable on the pivot. The detent can override the back portions' extending end when said seat portion is moved to a substantially vertical position above the back portion when the back portion is in a horizontal position. The detent may engage the back portions' extending end when the seat portion is in a substantially vertical position over the back portion and moved downward to interlock the seat portion and back portion when reverting the interlocked seat portion and back portion to reclining position. The back portion is moved away, releasing the locking engagement between the detent when the back portion is moved to the reclining position.

The seat portion and back portion are preferably frames and are pivotally engaged with guide means including grooves and bearings. The guide means include a first set, for substantially moving the back portion up and down and a second set for substantially moving the back portion forward and back.

The seat portion may be adapted to movably rest on the base. The back portion is adapted to rest on the base when it is in a horizontal position. The back rest is released as the back rest is guided so that its extending end is rotated away from engagement with the detent.

The sofa bed recliner may comprise a seat frame, including a rear piece, a front piece and side pieces and a back frame, including a rear piece, a front piece and side pieces. The side pieces of the back frame extend beyond the back frame's frame portion and straddle the seat frame. The seat frame and said back frame are pivotally engaged near the seat frame's rear piece in their respective side piece at the back frame's extending end. The extending end further extends a short distance beyond the point of pivotal engagement. There is a base including end supports, a rear cross beam and a front cross beam. The cross beams join the end supports. The end supports comprise a first leg, a second leg and at least a cross piece joining the legs. The seat frame and back frame are mounted on the base with the seat frame restable on the front cross beam of the base and the back frame restable on the rear cross beam of the base when the back frame is in a horizontal position. There are guide means adapted to guide the back frame. The guide means include first grooves in the crosspieces, first bearings in the side pieces of the back frame near the front piece of the back frame, the first grooves and first bearings adapted to guide the back frame substantially forward and back. There are second grooves in the second leg, second bearings in the back frame intermediate the side piece. The second grooves and second bearings are adapted to guide the back frame substantially up and down. The grooves and bearings are adapted to guide the pivotally engaged seat frame and back frame forward to a horizontal position and back to a reclining position. There is a detent on at least one of the seat frame's side pieces, the detent includes a pivot on which the detent is freely movable. The detent is adapted to override the back frame's extending end when the seat frame is pivoted to a substantially vertical position above the back frame when the back frame is in a substantially horizontal position. The detent further is adapted to engage the back frame's extending end when the seat frame is in the substantially vertical position to interlock the seat frame and back frame when the seat frame is moved downward from the substantially vertical position to revert the seat frame and back frame to a reclining position. The back frame is adapted to be guided away from the locking engagement with the detent when the back frame is moved to reclining position.

The end supports may include arm rest, the first and second grooves may include substantially horizontal components. The grooves are substantially horizontal and may include a down slope, and the second grooves are substantially vertical and may include a back slope. The detent is disengaged when the seat frame and back frame are in horizontal position when the frame and back frame are in reclining position.

The present invention is a sofa bed recliner ideally adapted to the advantage of the use of a futon as a combination seat cushion and mattress, such as disclosed in U.S. Pat. No. 4,642,823. The seat frame and back frame are simply mounted on a support base with interactive guide means on the back frame, enabling the interlocking of the seat frame and back frame and the easy shifting of the sofa bed recliner from reclining to horizontal position for sleeping or resting. The use of the freely pivotable detent and interactive guide means in the mount provides a structural strength and simplicity of structure having a distinctive advantage over the sofa bed recliner of U.S. Pat. No. 4,642,823, while enabling an interlocking and release feature with simpler, inexpensive and more effective structure.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWING

Referring now to the figures in greater detail, where like reference number denote like parts in the various figures.

DETAILED DESCRIPTION

Figure 1:
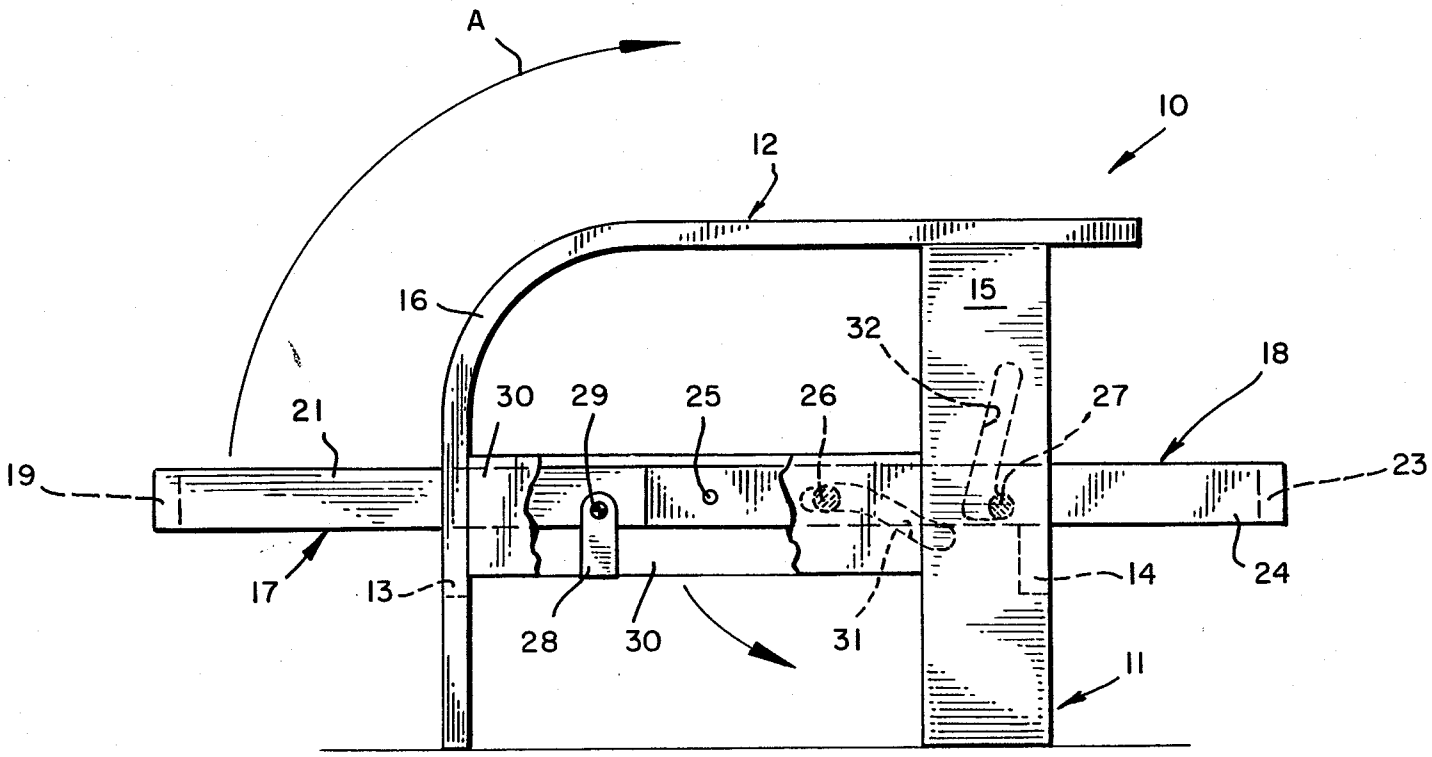
FIG. 1 is a side elevation of the sofa bed recliner of the present invention in the horizontal position.

The sofa bed recliner 10 as shown in the figures, comprises a base 11. The end supports 12 are joined by front cross beam 13 and a rear cross beam 14. The end supports 12 also include a leg 15 and a combination leg and arm rest 16.

The sofa bed recliner 10 includes a seat frame 17 and a back frame 18. The seat frame 17 has a front piece 19, a rear piece 20 and side pieces 21. The back frame 18 has a front piece 22, a rear piece 23 and side pieces 24. The side pieces 24 extend beyond the front piece 22 and are rotatably engaged at pivots 25 with the side pieces 21 of the seat frame 17. The side pieces 24 of the back frame 18 include a first bearing 26 and a second bearing 27, both bearings preferably rotatable. The seat frame 17 has at least one detent 28, including a pivot 29, on at least one side piece 21 adjacent the extending portions of at least one of the side pieces 24 of the back frame 18.

The leg 15 and combination leg and arm rest 16 of the end supports 12, are joined by cross pieces 30. The cross pieces 30 have guide channels 31, which engage a first bearing 26. The legs 15 have guide channels 32 which engage a second bearing 27.

In a preferred embodiment of the present invention, the sofa bed recliner 10 is made of wood. Even the first and second bearings 26, 27 are of wood and the guide channels 31, 32 are cut into the wood of the cross piece 30 and leg 15, respectively. The seat frame 17, whether in reclining position or horizontal position, rests on the front cross beam 13 of the end supports 12. The back frame 18, in reclining position, is in held in position by the first and second bearings 26, 27 in the guide channels 31, 32. In the horizontal position, the back frame 18 is supported by the rear cross beam 14, and is substantially lockable against collapse by the engagement of the second bearing 27 in the rearward extending portion of guide channel 32.

Operation

The sofa bed recliner 10 as shown in FIG. 1 is in its bed position with the back frame 18 and seat frame 17 horizontal. As can best be seen in FIG. 5, the guide channel 31 in the cross piece 30 has a horizontal component at its end and generally slopes downward. The guide channel 32 has a horizontal component at its end and is substantially vertical with a rearward angulation. As shown in FIG. 1, the second bearing 27 is engagable in the horizontal component of the guide channel 32 and the first bearing 26 is engagable in the horizontal component of the guide channel 31. In these positions, when the seat frame 17 and back frame 18 are horizontal, the bearings 26, 27 are lockable so that the seat frame 17 and back frame 18 are not likely to fold or pivot from any weight intermediate the extremities of the seat frame 17 and back frame 18. A sleeper will then have a firm base on which to sleep.

Figure 2:
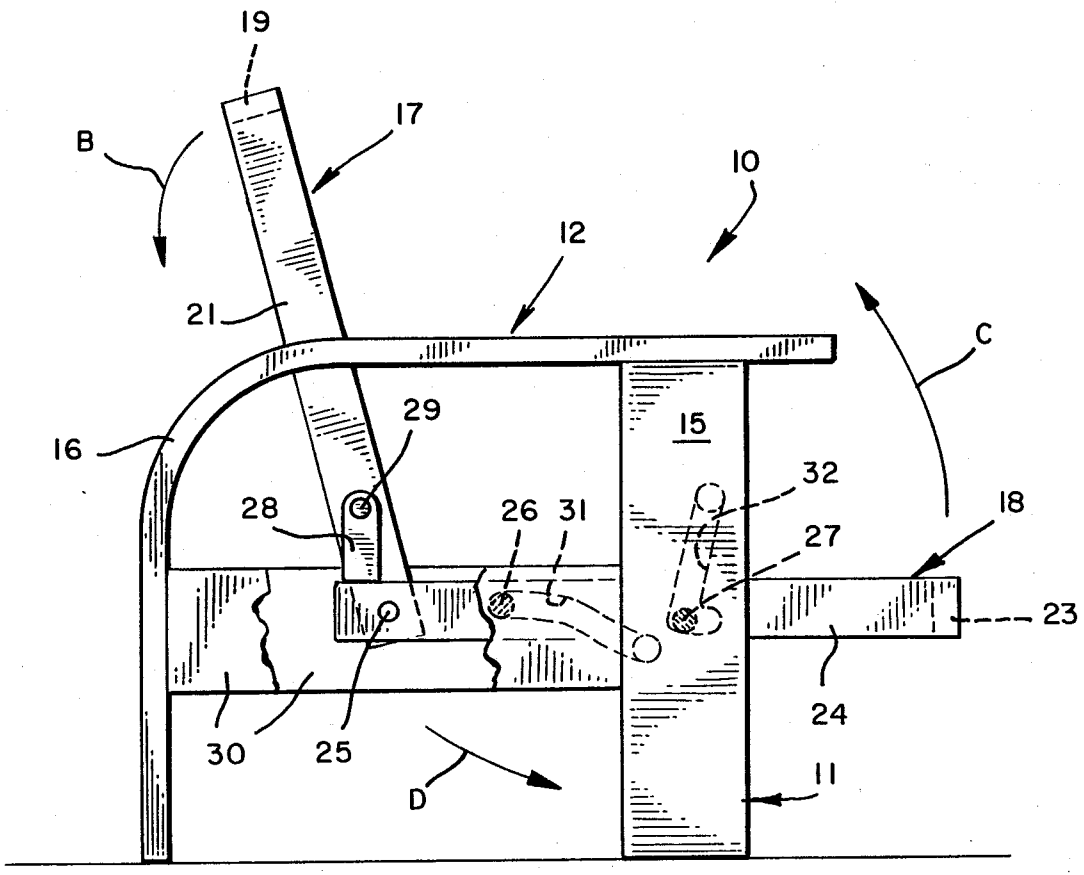
FIG. 2 is a side elevation of the sofa bed recliner of FIG. 1 with the seat and back frame engaged for reverting said frames to reclining position.

Converting the sofa bed recliner 10 back to its recliner position, the seat frame 17 is lifted and pivots on pivot 25 in the direction of arrow A, as shown in FIG. 1. The detent 28, on its pivot 29, remains vertical as the seat frame 17 is pivoted upward. It may be necessary to pull or jiggle the engaged seat frame 17 and back frame 18 so that they are unlocked in their horizontal positions with the bearings 26 and 27 engaged in the horizontal components of the respective guide channels 31 and 32. The seat frame 17 is then pivoted in the direction of arrow A on pivots 25. The detent 28, pivoting on the pivot 29, is freely movable and remains substantially vertical until it engages the extending end portions of the side pieces 24, as shown in FIG. 2. The detent 28 passes freely over the end portion of the side pieces 24 until it is lifted beyond these end portions, at which point the detent 28 becomes engagable with the end portion of the side pieces 24. A downward movement in the direction of arrow B, as shown in FIG. 2 interlocks the detent 28 with the side pieces 24 and, pivots the extending portion of the back frame 18 in the direction of arrow D and the rearward portion of the back frame 18 in the direction of arrow C. The first bearing 26 is guided downward in the channel 31, while the second bearing 27 is guided upward and slightly rearward in the guide channel 32 reverting the seat frame 17 and back frame 18 to reclining position.

Figure 3:
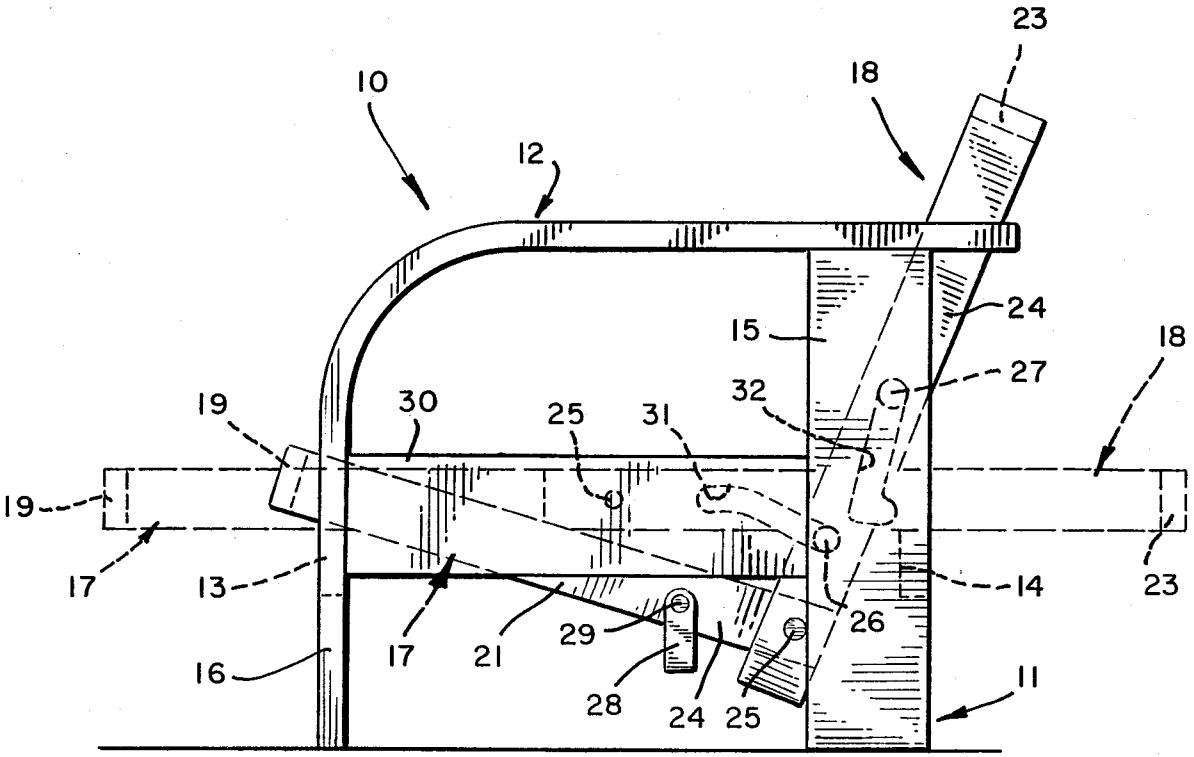
FIG. 3 is a side elevation of the sofa bed recliner of the present invention with the seat and back frame repositioned in the reclining position.

As shown in FIG. 3, when the seat frame 17 and back frame 18 are in reclining position, the second bearing 27 is stopped in the upper end of the guide channel 32 and the first bearing 26 is stopped in the lower end of the guide channel 31. The double pivoting of the back frame 18 guides the extending portion of the side piece 24 free of its engagement with the detent 28, which now hangs vertically again on its pivot 29.

Figure 4:
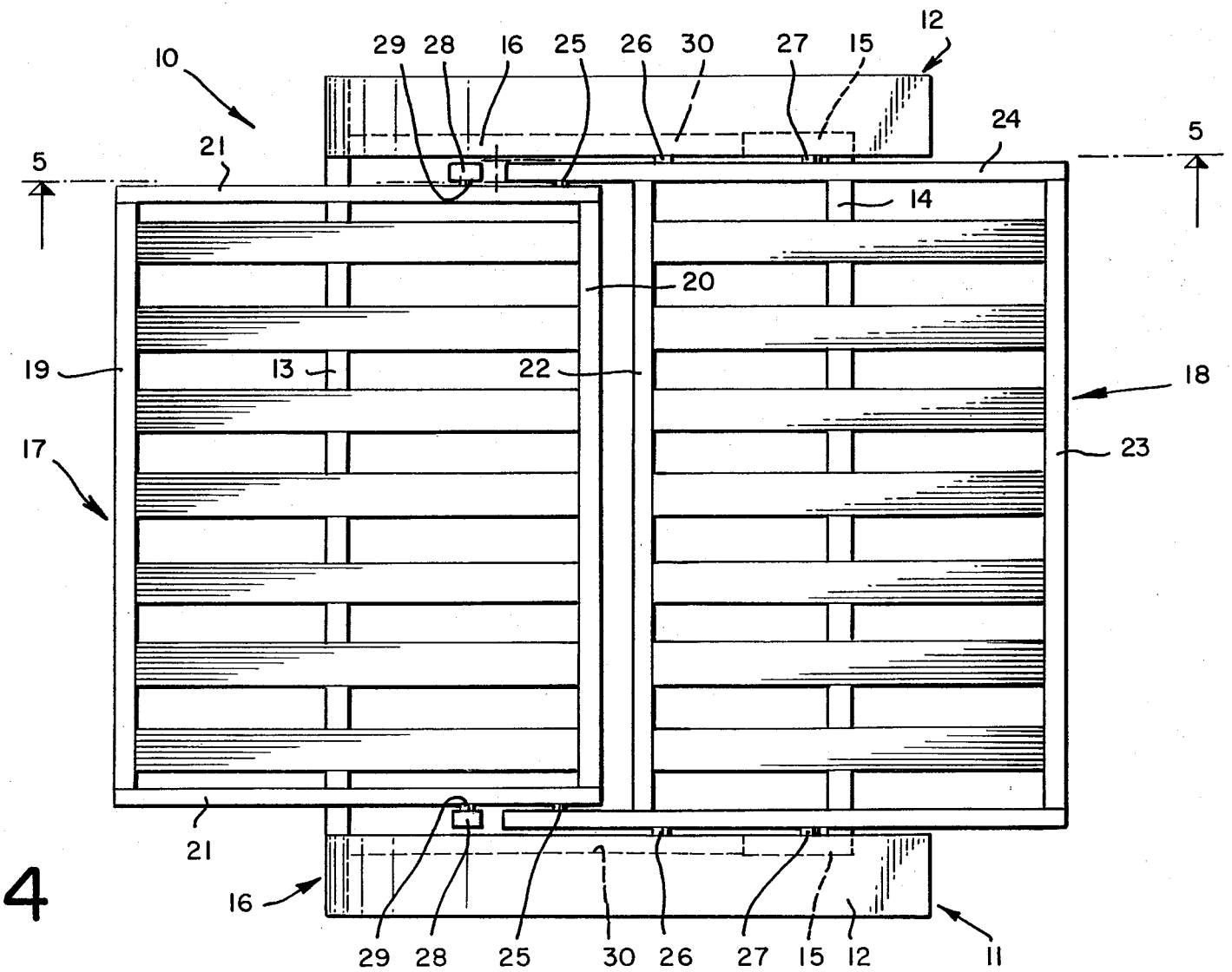
FIG. 4 is a top plan view of FIG. 1.
Figure 5:
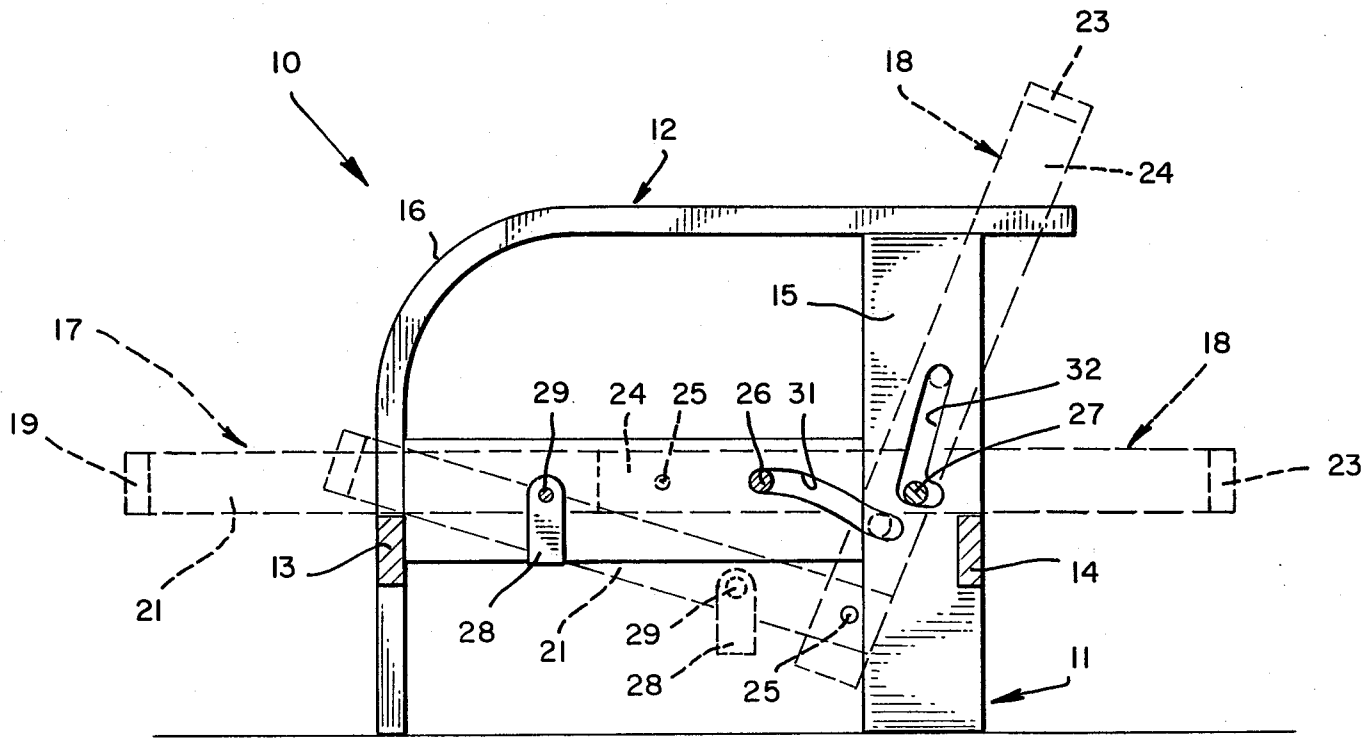
FIG. 5 is a section of FIG. 4 at lines 5—5.

FIG. 5, which is a section of FIG. 4 at lines 5—5, shows the guide channel 31 in a cross piece 30, with the first bearing engaged. The guide channel 32 in the leg 15 is shown with the second bearing 27 engaged. The end portion of the side piece 24, with its pivot 25, engagable with the side piece 21 of the seat frame 17, is shown in its relationship with the detent 28 on its pivot 29. Dotted in is the relative position of the seat frame 17 and back frame 18 in horizontal position and dotted in also is the relative positions of the seat frame 17, back frame 18 and first and second bearings 26 and 27 in the guide channels 31 and 32, showing a complete cycle of movements.

While the disclosure represents a preferred embodiment, including the first and second bearings 26 and 27 and guide channels 31 and 32, other mechanical arrangements might be employed to obtain the relative movement of the seat frame 17 and back frame 18, so that the detent 28 is enabled to pass over the end of the side piece 24, then be moved downward to engage it and revert the interlocked back frame 18 and seat frame 17 back to recliner position.

The seat frame 17 fits, cradled in the extending arms of the side pieces 24 of the back frame 18 with the end portions of the side pieces 24 extending beyond the pivot 25, so that they can engage the detent 28. The front piece 22 of the back frame 18 must be spaced away and rotatable over the rear piece 20 of the seat frame 17. The detent 28 must be of a size selected so that when the seat frame 17 is pivoted upward in the direction of arrow A on the pivot 25, that it completely overrides the side piece 24 so that it may be swung downward to engage the end of the side piece 24 to perform the locking operation.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. A sofa bed recliner comprising seating means, back rest means, said back rest means including a longitudinally extending portion, said seating means and said back rest means movably engaged, said back rest means' longitudinally extending portion extendable over part of said seating means, a base, said seating means and said back rest means mounted on said base, guide means adapted to guide said back rest means to move substantially forward and back and substantially up and down on said base, said movably engaged seating means and back rest means adapted to move forward to a horizontal position and back to a reclining position on said base, detent means on said seating means, said detent means including a pivot, said detent means freely movable on said pivot, said detent means adapted to freely move to override said back rest means' longitudinally extending portion when said seating means is moved to a substantially vertical position above said back rest means when said back rest means is in a horizontal position, said detent means further adapted to automatically engage said back rest means' longitudinally extending portion from said seating means' substantially vertical position upon downward movement of said seating means to interlock said seating means and back rest means, said interlocked seating means and back rest means adapted to be reverted to reclining position upon downward movement of said seating means, and said back rest means adapted to release said locking engagement with said detent means when said back rest means is moved to a reclining position.

2. The invention of claim 1 wherein said seating means and back rest means are frames.

3. The invention of claim 2 wherein said seating means and back rest means are pivotally engaged.

4. The invention of claim 1 wherein said guide means include grooves and bearings.

5. The invention of claim 4 wherein said guide means include a first set of grooves and bearings for substantially guiding said back rest means up and down and a second set of grooves and bearings for substantially guiding said back rest means forward and back.

6. The invention of claim 1 wherein said seating means is adapted to movably rest on said base and said back rest means is adapted to rest on said base when in horizontal position.

7. A sofa bed recliner comprising a seat frame, said seat frame including a rear piece; a front piece; and side pieces, a back frame, said back frame including a rear piece; a front piece; and side pieces, said side pieces of said back frame extending beyond said back frame's frame portion and adapted to straddle said seat frame, said seat frame and said back frame pivotally engaged near said seat frame's rear piece in said respective side piece at said back frame's extending portion, said extending portion further extending a short distance beyond said point of pivotal engagement, a base, said base including end supports; a rear cross beam; and a front cross beam, said cross beams joining said end supports, said end supports comprising a first leg; a second leg; and at least one cross piece joining said legs, said seat frame and back frame mounted on said base, said seat frame restable on said front cross beam of said base, said back frame restable on said rear cross beam of said base when said back frame is in a horizontal position, guide means adapted to guide said back frame, said guide means including first grooves in said crosspieces; first bearings in said side pieces of said back frame near said front piece of said back frame; said first grooves and first bearings adapted to guide said back frame substantially forward and back; second grooves in said second leg; second bearings in said back frame intermediate said side piece; said second grooves and second bearings adapted to guide said back frame substantially up and down; said grooves and bearings adapted to guide said pivotally engaged seat frame and back frame forward to a horizontal position and back to a reclining position, a detent on at least one of said seat frame's side pieces, said at least one detent including a pivot, said detent freely movable on said pivot, said at least one detent adapted to override said back frame's extending portion when said seat frame is pivoted to a substantially vertical position above said back frame when said back frame is in a substantially horizontal position, said detent further adapted to engage said back frame's extending portion when said seat frame is in said substantially vertical position, said detent adapted to interlock said seat frame and back frame when said seat frame is moved downward from said substantially vertical position to revert said seat frame and back frame to a reclining position, and said back frame adapted to be guided away from said locking engagement with said at least one detent when said back frame is moved to reclining position.

8. The invention of claim 7 wherein at least one of said end supports includes an arm rest.

9. The invention of claim 7 wherein said first and second grooves include a substantially horizontal component.

10. The invention of claim 9 wherein said first grooves are substantially horizontal and include a down slope, and said second grooves are substantially vertical and include a back slope.

11. The invention of claim 7 wherein said detent is disengaged when said seat frame and back frame are in horizontal position.

12. The invention of claim 7 wherein said detent is disengaged when said seat frame and back frame are in reclining position.

13. A sofa bed recliner comprising a seat frame, a back frame, said back frame including an extending portion, said seat frame and said back frame pivotally engaged, a base, said seat frame and said back frame mounted on said base, a first set of grooves and bearings adapted to substantially guide said back frame to move up and down, a second set of grooves and bearings adapted to substantially guide said back frame to move forward and back, said back frame adapted to rest on said base when in a horizontal position, said seat frame adapted to movably rest on said base, said pivotally engaged seat frame and back frame adapted to move forward to a horizontal position and back to a reclining position on said base, detent means on said seat frame, said detent means including a pivot, said detent means freely movable on said pivot, said detent means adapted to override said back frame's extending portion when said seat frame is moved to a substantially vertical position above said back frame when said back frame is in a horizontal position, said detent means further adapted to engage said back frame's extending portion from said seat frame's substantially vertical position to interlock said seat frame and back frame, said interlocked seat frame and back frame adapted to be reverted to a reclining position upon downward movement of said seat frame, and said back frame including means to guide said extending portion to rotate away from engagement with said detent means to release said locking engagement with said detent means when said back frame is moved to a reclining position.

* * * * *

Adverse Decision in Interference

In Interference No. 102,293, involving Patent No. 4,829,611, R. Fireman, G. Shaffield, SOFA BED RECLINER, final judgment adverse to the patentees was rendered June 26, 1990, as to claims 1-4 and 6.

*[Official Gazette August 28, 1990]*

US004829611B1

REEXAMINATION CERTIFICATE (2396th)

United States Patent [19]

[11] B1 4,829,611

Fireman et al.

[45] Certificate Issued Sep. 20, 1994

[54] SOFA BED RECLINER

[76] Inventors: Robert Fireman, 785 West End Ave., New York, N.Y. 10025; Gary Shaffield, 220 Gillen Dr., Sparta, Tenn. 38583

Reexamination Request:
No. 90/003,144, Jul. 26, 1993

Reexamination Certificate for:

| | |
|---|---|
| Patent No.: | **4,829,611** |
| Issued: | **May 16, 1989** |
| Appl. No.: | **180,398** |
| Filed: | **Apr. 12, 1988** |

[51] Int. Cl.[5] ..... A47C 17/04
[52] U.S. Cl. ..... 5/47; 5/37.1; 5/41
[58] Field of Search ..... 5/37.1, 47, 41, 147; 297/354.1

[56] References Cited

U.S. PATENT DOCUMENTS

| | | | |
|---|---|---|---|
| 702,959 | 6/1902 | Jones | 5/47 |
| 820,826 | 5/1906 | Seng | 5/47 |
| 828,124 | 8/1906 | Kelly | 5/47 |
| 839,118 | 12/1906 | Crouch | 5/47 |
| 871,022 | 11/1907 | Anthony | 5/47 |
| 2,294,475 | 9/1942 | McAllister | 5/47 |
| 3,634,893 | 1/1972 | Hern et al. | 5/37.1 |
| 4,642,823 | 2/1987 | Wiggins | 5/47 |
| 4,875,244 | 10/1989 | Tremblay | 5/37.1 |

FOREIGN PATENT DOCUMENTS

| | | | |
|---|---|---|---|
| 79499 | 7/1955 | Denmark | 5/41 |

*Primary Examiner*—Michael Milano

[57] ABSTRACT

A sofa bed recliner which provides a sturdy, simpler inexpensive structure for reverting a seat frame and back frame from a horizontal position to a reclining position by the engagement of a freely pivotable detent, which interlocks the frames, allowing the frames to be simultaneously moved from a horizontal to a reclining position. The detent is automatically released as the back frame resumes reclining position.

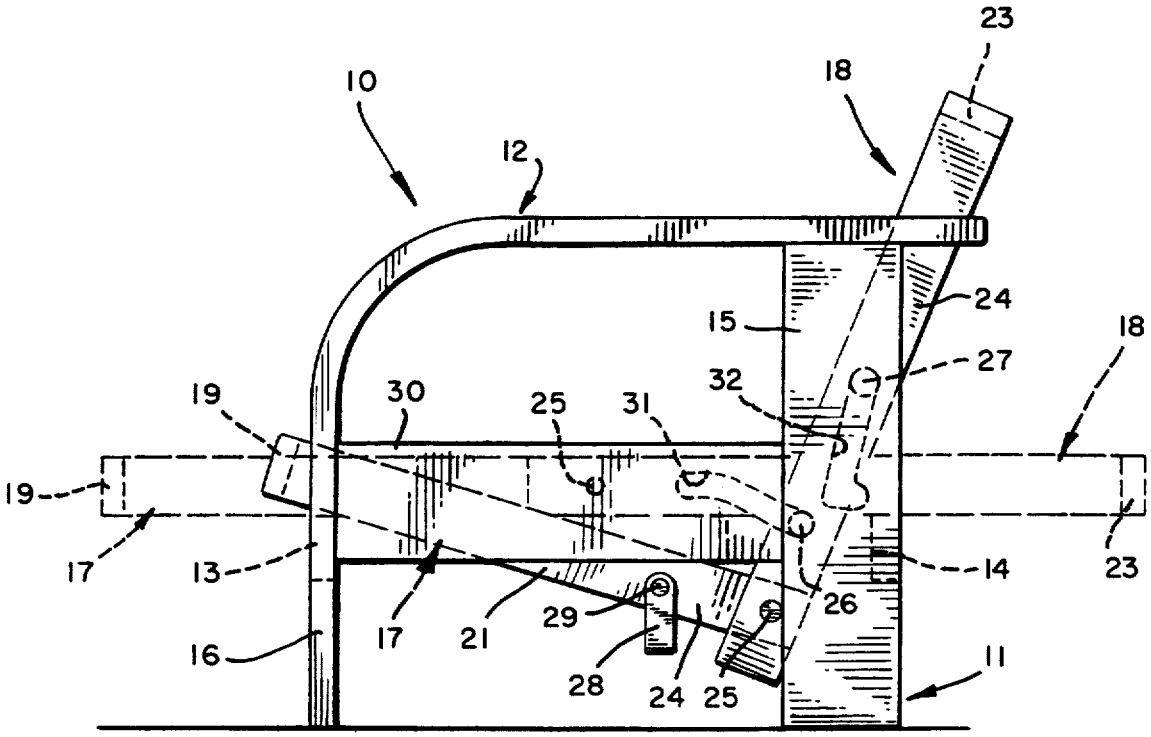

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7–12 is confirmed.

Claims 1–4 and 6 are cancelled.

Claims 5 and 13 are determined to be patentable as amended.

New claims 14–17 are added and determined to be patentable.

5. [The invention of claim 4 wherein said] *A sofa bed recliner comprising seating means, back rest means, said back rest means including a longitudinally extending portion, said seating means and said back rest means movable engaged, said back rest means' longitudinally extending portion extendable over part of said seating means, a base, said seating means and said back rest means mounted on said base, said movably engaged seating means and back rest means adapted to move forward to a longitudinal position and back to a reclining position on said base,* guide means [include] *including* a first set of grooves and bearings for substantially guiding said back rest means up and down and a second set of grooves and bearings for substantially guiding said back rest means forward and back, *the groove of said first set of grooves and bearings being substantially vertically aligned and the bearing in said groove moving downwardly during the movement of said back rest means to said horizontal position and upwardly during the movement of said back rest means to said reclining position, detent means on said seating means, said detent means including a pivot, said detent means freely movable on said pivot, said detent means adapted to freely move to override said back rest means longitudinally extending portion when said seating means is moved to a substantially vertical position above said back rest means when said back rest means is in a horizontal position, said detent means further adapted to automatically engage said back rest means' longitudinally extending portion from said seating means substantially vertical position upon downward movement of said seating means to interlock said seating means and back rest means, said interlocked seating means and back rest means adapted to be reverted to reclining position upon downward movement of said seating means, and said back rest means adapted to release said locking engagement with said detent means when said back rest means is moved to a reclining position.*

13. A sofa bed recliner comprising a seat frame, a back frame, said back frame including an extending portion, said seat frame and said back frame pivotally engaged, a base, said seat frame and said back frame mounted on said base, a first set of grooves and bearings adapted to substantially guide said back frame to move up and down, *the bearings of the said first set of grooves and bearings being relatively higher when the back frame is moved up as compared to their position when said back frame is moved down and relatively lower when said back frame is moved down as compared to their position when said back frame is moved up,* a second set of grooves and bearings adapted to substantially guide said back frame to move forward and back, said back frame adapted to rest on said base when in a horizontal position, said seat frame adapted to movably rest on said base, said pivotally engaged seat frame and back frame adapted to move forward to a horizontal position and back to a reclining position on said base, detent means on said seat frame, said detent means including a pivot, said detent means freely movable on said pivot, said detent means adapted to override said back frame's extending portion when said seat frame is moved to a substantially vertical position above said back frame when said back frame is in a horizontal position, said detent means further adapted to engage said back frame's extending portion from said seat frame's substantially vertical position to interlock said seat frame and back frame, said interlocked seat frame and back frame adapted to be reverted to a reclining position upon downward movement of said seat frame, and said back frame including means to guide said extending portion to rotate away from engagement with said detent means to release said locking engagement with said detent means when said back frame is moved to a reclining position.

*14. The invention as claimed in claim 7 wherein the sofa bed recliner is constructed of wood.*

*15. The invention as claimed in claim 13 wherein the sofa bed recliner is constructed of wood.*

*16. The invention as claimed in claim 5 wherein the sofa bed recliner is constructed of wood.*

*17. A sofa bed recliner having a front and a back comprising a seat frame, a back frame, said back frame including an extending portion, said seat frame and said back frame pivotally engaged at a point along their length, a base, said seat frame and said back frame mounted on said base, a first set of grooves and bearings adapted to substantially guide said back frame to move up and down, said first set of grooves and bearings being located toward the back of the sofa bed recliner relative to the location of the point of pivotal engagement of said seat frame and said back frame, a second set of grooves and bearings adapted to substantially guide said back frame to move foward and back, said back frame adapted to rest on said base when in a horizontal position, said seat frame adapted to movably rest on said base, said pivotally engaged seat frame and back frame adapted to move forward to a horizontal position and back to a reclining position on said base, detent means on said seat frame, said detent means including a pivot, said detent means freely movable on said pivot, said detent means adapted to override said back frame's extending portion when said seat frame is moved to a substantially vertical position above said back frame when said back frame is in a horizontal position, said detent means further adapted to engage said back frame's extending portion from said seat frame's substantially vertical position to interlock said seat frame and back frame, said interlocked seat frame and back frame adapted to be reverted to a reclining position upon downward movement of said seat frame, and said back frame including means to guide said extending portion to rotate away from engagement with said detent means to release said locking engagement with said detent means when said back frame is moved to a reclining position.*

* * * * *